US007882603B2

(12) United States Patent
Bentsen

(10) Patent No.: US 7,882,603 B2
(45) Date of Patent: Feb. 8, 2011

(54) END STOPS FOR ZIPPERS FOR RECLOSABLE PACKAGES

(75) Inventor: Per Bentsen, Suffern, NY (US)

(73) Assignee: Illinois Tool Works Inc., Glenview, IL (US)

( * ) Notice: Subject to any disclaimer, the term of this patent is extended or adjusted under 35 U.S.C. 154(b) by 606 days.

(21) Appl. No.: 11/973,703

(22) Filed: Oct. 10, 2007

(65) Prior Publication Data

US 2009/0094803 A1 Apr. 16, 2009

(51) Int. Cl.
*B65D 33/16* (2006.01)

(52) U.S. Cl. ..... 24/436; 383/64

(58) Field of Classification Search ..... None
See application file for complete search history.

(56) References Cited

U.S. PATENT DOCUMENTS 6,470,551 B1 10/2002 Provan et al.
6,569,368 B2 5/2003 Machacek
6,846,107 B2 1/2005 Sweeney et al.
2004/0014579 A1 1/2004 Sweeney
2007/0177827 A1 8/2007 Tilman
2007/0240288 A1 10/2007 Bentsen

FOREIGN PATENT DOCUMENTS

EP 1 364 768 A 11/2003

*Primary Examiner*—Jack W. Lavinder
(74) *Attorney, Agent, or Firm*—Day Pitney LLP

(57) ABSTRACT

The end stop is formed on ends of a zipper for a reclosable package or bag by ultrasonically welding the ends of the zipper profiles together so as to form a raised portion. This prevents the slider from being pulled off of the ends of the zipper. Additionally, in the ultrasonic welding step, an indentation is formed into which glue is added thereby forming a lateral protrusion on the side of a zipper profile. This increases the strength of the end stop and increases the slider pull-off force which can be resisted.

20 Claims, 1 Drawing Sheet

END STOPS FOR ZIPPERS FOR RECLOSABLE PACKAGES

BACKGROUND OF THE INVENTION

1. Field of the Invention

The present invention relates to the formation of end stops for zippers for reclosable packages or bags, particularly end stops which include a seated formation of glue to increase the strength thereof.

2. Description of the Prior Art

The prior art of reclosable packages is well-developed and generally suitable for its intended purposes. It is well-known in this prior art to provide slider-operated zippers for the reclosable packages, and to form end stops on the zippers to limit the extent of the travel of the slider. This prevents the slider from being moved beyond the end of the zipper and removed from the zipper. A typical end stop which includes an ultrasonically-formed raised portion, such as illustrated in FIG. 1, may have a maximum slider pull-off force of fifteen pounds. The use of glue to form end stops is disclosed in U.S. patent application Ser. No. 11/405,786, entitled "High Strength Slider End Stop", filed on Apr. 18, 2006 by the present inventor. Other prior art relating to end stops for slider-operated zippers for reclosable packages includes U.S. Pat. No. 6,569,368 entitled "Method for Manufacturing a Plastic Zipper with End Stops", issued on May 27, 2003 to Machacek; U.S. Pat. No. 6,470,551 entitled "Method of Making a Fastener Arrangement with Notches at Spaced Preseals", issued on Oct. 29, 2002 to Provan et al.; and U.S. Pat. No. 6,846,107 entitled "Glue Drop End Stops for Zippered Bag", issued on Jan. 25, 2005 to Sweeney et al.

OBJECTS AND SUMMARY OF THE INVENTION

It is therefore an object of the present invention to provide improvements in end stops for slider-operated zippers for reclosable packages or bags.

It is therefore a further object of the present invention to provide improvements in end stops formed with glue, particularly to be able to withstand a slider pull-off force of at least twenty pounds.

These and other objects are attained by providing an end stop with a formation of glue extending from the zipper profile, wherein the glue is inserted into an indentation, notch or cavity formed in the zipper profile by an ultrasonic horn.

BRIEF DESCRIPTION OF THE DRAWINGS

Further objects and advantages of the invention will become apparent from the following description and from the accompanying drawings and claims, wherein:

DETAILED DESCRIPTION OF THE PREFERRED EMBODIMENTS

Figure 1:
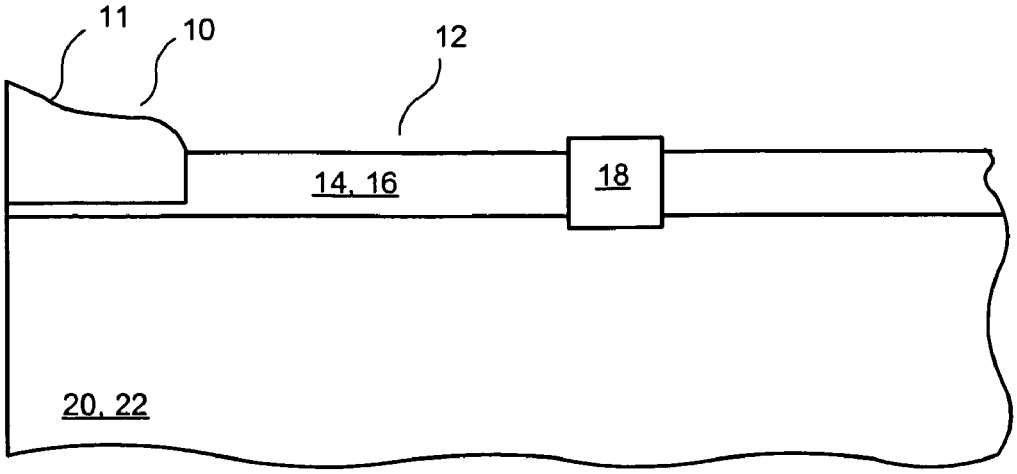
FIG. 1 PRIOR ART
FIG. 1 is a plan view of a prior art end stop for a reclosable zipper, shown with a fragmentary view of the reclosable zipper and the reclosable package.
Figure 2:
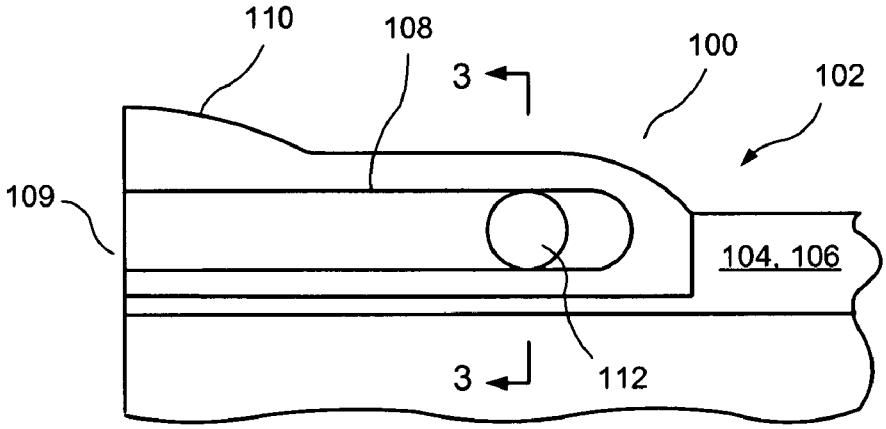
FIG. 2 is a plan view of the end stop of the present invention.

Referring now to the drawings in detail wherein like numerals indicate like elements throughout the several views, one sees that FIG. 1 is a plan view of a prior art end stop 10 at the end of zipper 12. Zipper 12 is formed from polymeric material or similar material as would be known to those skilled in the art. Zipper 12 includes first and second interlocking profiles 14, 16 which are joined or fused (typically ultrasonically) together at both ends by an end stop 10 (only one end is illustrated in FIG. 2). Zipper 12 further includes a slider 18 which separates the first and second interlocking profiles 14, 16 when moved in an opening direction and which interlocks the first and second profiles 14, 16 when moved in a closing direction. First and second profiles 14, 16 include respective first and second flanges which are sealed to respective first and second sheets of polymeric material 20, 22 which form the walls of the reclosable package 40. This prior art end stop 10 includes a raised portion 11 extending above zipper 12, formed from the material of the first and second profiles 14, 16 and shaped in the upwardly rising shape by an ultrasonic horn (not shown). The prior art configuration, in many applications, will typically resist a 15 pound pull-off force on the slider, although this number may vary with specific configuration.

Figure 3:
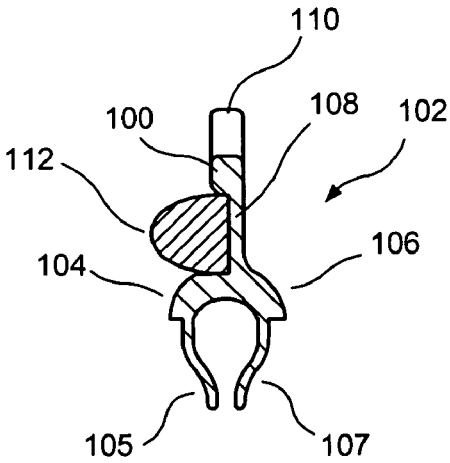
FIG. 3 is a cross-sectional view along plane 3-3 in FIG. 2.

FIGS. 2 and 3 are respective plan and cross-sectional views of the end stop 100 and zipper 102 (likewise formed from polymeric or similar material) of the present invention. As shown in FIG. 3, first and second zipper profiles 104, 106 of zipper 102 are shown in the sealed together configuration of end stop 100 and include respective first and second flanges 105, 107 for attachment to the walls of the reclosable package or bag. End stop 100 is similarly formed at both ends of the zipper 102 wherein first and second zipper profiles 104, 106 are sealed together. However, as shown in FIGS. 2 and 3, an indentation 108 is formed by the ultrasonic horn on the face of first zipper profile 104. This indentation 108 typically extends from an outer edge 109 of the end stop 100 through a substantial portion of the length of the end stop and is typically formed during the same ultrasonic welding step that seals first and second zipper profiles 104, 106 together in the area of end stop 100 and that further forms the upwardly extending portion 110 of end stop 100. A dot or "glob" of glue 112 is typically at least partially ovoid or hemispherically shaped (other possible shapes, of course, are envisioned), bonds itself into indentation 108 and extends laterally as a protrusion from first zipper profile 104. The extent of the protrusion of dot or "glob" of glue 112 is typically substantially equal in distance to the width (as measured vertically in the orientation of FIG. 2) of indentation 108. It has been found that hot melt glue is a highly satisfactory glue for this purpose. Additionally, it has been found that using an indentation with a horizontal extent (in the orientation of FIG. 2) greater than the diameter of the dot or "glob" of glue 112 allows for variation, and reduces the need for precision, in the placement of the dot or "glob" of glue 112 during the manufacturing process. This configuration is envisioned to resist an increased pull-off force on the slider with respect to the prior art configurations. A typical configuration of the present invention is envisioned to resist a 20 pound pull-off force on the slider, although this number, as with the number associated with the prior art, may vary with specific configuration.

Figure 4:
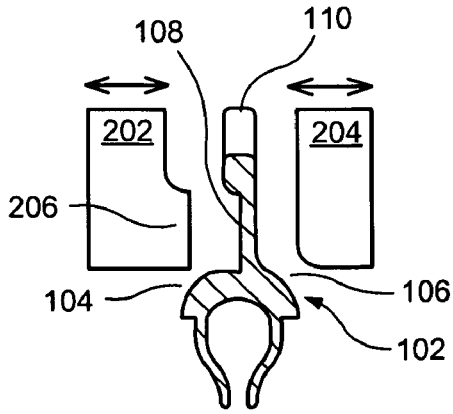
FIG. 4 is a cross-sectional view similar to FIG. 3, illustrating the formation of the indentation into which the dot of glue is seated.

FIG. 4 illustrates ultrasonic welding elements 202, 204 (one or both of which may be movable) impressing against the zipper 102 in order to form end stop 100. Ultrasonic welding elements 202, 204 seal first and second zipper profiles 104, 106 together and form the upwardly extending portion 110 in a single step. Additionally, in this single step, ultrasonic welding element 202 includes protrusion 206 which forms indentation 108 into which the dot or "glob" of glue 112 is subsequently seated.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package or bag, comprising:

a first interlocking profile and a second interlocking profile, wherein the first interlocking profile includes an indentation on a side thereof, the indentation being free of passage through the first interlocking profile; and end stops formed at ends of the zipper by joining respective ends of the first and second interlocking profiles, the end stops further including a protrusion of glue seated in the indentation and extending laterally from the side of the first interlocking profile.

2. The zipper of claim 1 further including a slider mounted on the first and second interlocking profiles.

3. The zipper of claim 2 wherein the slider interlocks the first and second interlocking profiles when moved in a closing direction and separates the first and second interlocking profiles when moved in an opening direction.

4. The zipper of claim 1 wherein the protrusion of glue is at least partially ovoid shaped.

5. The zipper of claim 1 wherein the protrusion of glue is bonded into the indentation.

6. The zipper of claim 1 wherein the protrusion of glue bonds itself into the indentation.

7. The zipper of claim 1 wherein the indentation has a generally rectangular shape.

8. The zipper of claim 7 wherein the protrusion of glue extends a lateral distance which is substantially equal to a height of the indentation.

9. The zipper of claim 1 wherein the indentation is formed ultrasonically.

10. The zipper of claim 9 wherein the end stops include a portion rising above the zipper.

11. The zipper of claim 10 wherein the portion rising above the zipper is formed from material of the zipper.

12. The zipper of claim 11 wherein the portion rising above the zipper is formed ultrasonically.

13. The zipper of claim 1 wherein the first and second interlocking profiles include respective first and second flanges.

14. The zipper of claim 13 wherein the first and second flanges are constructed and arranged for attachment to package or bag walls of polymeric material.

15. The zipper of claim 1 wherein the zipper is formed from polymeric material.

16. The zipper of claim 1 wherein the protrusion of glue is formed from hot melt glue.

17. The zipper of claim 1 wherein the second interlocking profile is free of a protrusion of glue.

18. A zipper for a reclosable package or bag, comprising:

a first interlocking profile and a second interlocking profile, wherein the first interlocking profile includes an ultrasonically-formed indentation on a side thereof; and end stops formed at ends of the zipper by joining respective ends of the first and second interlocking profiles, the end stops further including a protrusion of glue in the indentation and extending laterally from the side of the first interlocking profile;

the end stops further including a ultrasonically-formed portion rising above the zipper, the portion formed from material of the zipper; and the respective ends of the first and second interlocking profiles being joined ultrasonically.

19. The zipper of claim 18 wherein the indentation, the portion rising above the zipper, and the joining the respective ends of the first and second interlocking profiles are formed by a single ultrasonic welding step.

20. A zipper for a reclosable package or bag, comprising:

a first interlocking profile and a second interlocking profile, wherein the first interlocking profile includes an indentation on a side thereof;

end stops formed at ends of the zipper by joining respective ends of the first and second interlocking profiles, the end stops further including a protrusion of glue in the indentation and extending laterally from the side of the first interlocking profile; and wherein the end stop can withstand a slider pull-off force of at least 20 pounds.

* * * * *